US010240848B2

(12) United States Patent
Moon

(10) Patent No.: US 10,240,848 B2
(45) Date of Patent: Mar. 26, 2019

(54) REFRIGERATOR

(71) Applicant: Dongbu Daewoo Electronics Corporation, Seoul (KR)

(72) Inventor: Jung Won Moon, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/481,328

(22) Filed: Apr. 6, 2017

(65) Prior Publication Data

US 2017/0292762 A1 Oct. 12, 2017

(30) Foreign Application Priority Data

Apr. 7, 2016 (KR) ..... 10-2016-0042874

(51) Int. Cl.

| | |
|---|---|
| ***F25D 11/02*** | (2006.01) |
| ***F25D 17/04*** | (2006.01) |
| ***F25D 21/08*** | (2006.01) |
| ***F25D 23/00*** | (2006.01) |
| *F25D 17/06* | (2006.01) |

(52) U.S. Cl.

CPC ..... *F25D 17/042* (2013.01); *F25D 11/02* (2013.01); *F25D 21/08* (2013.01); *F25D 23/006* (2013.01); *F25D 17/065* (2013.01); *F25D 2317/0411* (2013.01); *F25D 2400/06* (2013.01)

(58) Field of Classification Search

CPC . F25D 21/08; F25D 2317/0411; F25D 17/042
See application file for complete search history.

(56) References Cited

U.S. PATENT DOCUMENTS

| | | | | |
|---|---|---|---|---|
| 2,090,413 A * | 8/1937 | Gould | F25D 17/042 | 62/150 |
| 2,281,815 A * | 5/1942 | Altenkirch | F25D 17/042 | 165/905 |
| 3,204,388 A * | 9/1965 | Asker | B01D 53/04 | 95/119 |
| 3,587,242 A * | 6/1971 | Togino, et al. | F25B 39/026 | 62/441 |
| 3,719,056 A * | 3/1973 | Hock | A23G 9/20 | 62/136 |
| 5,226,298 A * | 7/1993 | Yamamoto | F25B 21/02 | 62/281 |
| 5,784,896 A * | 7/1998 | Tronnes | F25D 17/062 | 62/285 |

(Continued)

FOREIGN PATENT DOCUMENTS

| | | |
|---|---|---|
| JP | 2008-121949 | 5/2008 |
| JP | 4767047 | 6/2011 |

(Continued)

*Primary Examiner* — Kun Kai Ma

(57) ABSTRACT

A refrigerator including a moisture absorbing unit configured to absorb moisture in the cold air surrounding the evaporator. The moisture absorbing unit includes a moisture absorbing material. Therefore, undesirable frosting on the evaporator can be effectively prevented. The moisture absorbing unit can be heated by a defrosting heater disposed proximate to the evaporator and the moisture absorbing unit. Thus moisture in the moisture absorbing material can be removed and the moisture absorbing material can be repeatedly used.

14 Claims, 7 Drawing Sheets

(56) References Cited

U.S. PATENT DOCUMENTS

| | | | | |
|---|---|---|---|---|
| 5,797,280 | A * | 8/1998 | Lee | F25D 17/045 62/408 |
| 2008/0093059 | A1* | 4/2008 | Nishida | B01D 53/261 165/133 |
| 2009/0013709 | A1* | 1/2009 | Kim | F25D 21/08 62/276 |
| 2009/0158928 | A1* | 6/2009 | Wu | B01D 53/265 95/115 |
| 2010/0000243 | A1* | 1/2010 | Morimoto | F24F 1/022 62/176.6 |
| 2010/0107681 | A1* | 5/2010 | Morimoto | F24F 1/0059 62/498 |

FOREIGN PATENT DOCUMENTS

| | | |
|---|---|---|
| KR | 10-1997-0028311 A | 6/1997 |
| KR | 10-2009-0006612 | 1/2009 |

* cited by examiner

REFRIGERATOR

CROSS-REFERENCE TO RELATED APPLICATION

This application is based on and claims priority from Korean Patent Application No. 10-2016-0042874, filed on Apr. 7, 2016, the disclosure of which is incorporated herein in its entirety by reference for all purposes.

TECHNICAL FIELD

The present disclosure relates to refrigerators, and more particularly, to defrosting mechanisms for evaporators in refrigerators.

BACKGROUND

In general, a refrigerator is an apparatus for storing various types of items, e.g., food, at low temperature. Low temperature in the refrigerator is achieved by circulating cold air that can be continuously generated through a heat exchange process by using a refrigerant. During operation, the refrigerant goes through repetitive cycles of compression, condensation, expansion and evaporation.

During cold air circulation, the cold air that has flown through the interior of the refrigerator can return to the space where an evaporator is installed and is subject to heat exchange with the evaporator again. Then, the cold air can be supplied to other places of the refrigerator again.

However, cold air that has returned to a cold air generation compartment (hereinafter, referred to as "returned cold air") likely contains a large amount of moisture. The moisture can adhere to the evaporator. Due to heat exchange between the returned cold air and the evaporator, moisture adherent to the evaporator tends to freeze and become unwanted frost.

Frost on the evaporator can compromise heat exchange efficiency of the evaporator. As a result, defrosting time of the refrigerator needs to be increased, thereby leading to increased power consumption of the refrigerator.

Patent Document: Korean Patent Application No. 10-2009-0006612 (filed on Jan. 15, 2009)

SUMMARY

Embodiments of the present disclosure provide a mechanism in a refrigerator for removing moisture contained in cold air in the vicinity of an evaporator and thereby can reduce the required defrosting time of the refrigerator as well as reduce power consumption.

The present disclosure provides a refrigerator, comprising: a main body having a storage space; a refrigerant line, disposed in the main body, through which a refrigerant flows; an evaporator, disposed in the main body, configured to generate cold air by evaporating the refrigerant flowing through the refrigerant line; a defrosting heater, disposed below the evaporator, and configured to remove frost deposited on the evaporator; and a moisture absorbing unit, disposed between the evaporator and the defrosting heater, and configured to absorb moisture in the cold air returning to the evaporator.

Further, the present disclosure also provides a refrigerator, wherein the moisture absorbing unit includes: an accommodating case, coupled to the refrigerant line, having fine holes through which the cold air returning to the evaporator passes; and a moisture absorbing member accommodated in an accommodating space in the accommodating case.

Further, the present disclosure also provides a refrigerator, wherein moisture in the cold air returning to the evaporator is absorbed by the moisture absorbing member and then evaporates during operation of the defrosting heater.

Further, the present disclosure also provides a refrigerator, wherein the accommodating case includes protrusions projecting from an outer surface of the accommodating case which allow close contact between the accommodating case and the refrigerant line.

Further, the present disclosure also provides a refrigerator, wherein coupling grooves rounded to correspond to a radius of curvature of the refrigerant line are formed at side surfaces above the protrusions of the accommodating case.

Further, the present disclosure also provides a refrigerator, wherein the moisture absorbing member includes silica gel.

Further, the present disclosure also provides a refrigerator, and further comprising a cooling pin that allows the refrigeration line to penetrate therethrough and increases a surface area of the evaporator.

Further, the present disclosure provides a refrigerator, comprising: a main body including a storage space; a refrigerant line, disposed in the main body, through which a refrigerant flow; an evaporator, disposed in the main body, configured to generate cold air by evaporating the refrigerant flowing through the refrigerant line; a defrosting heater, disposed below the evaporator, and configured to remove frost deposited on the evaporator; and a cooling pin that allows the refrigeration line to penetrate therethrough and increases a surface area of the evaporator.

DETAILED DESCRIPTION

Figure 1:
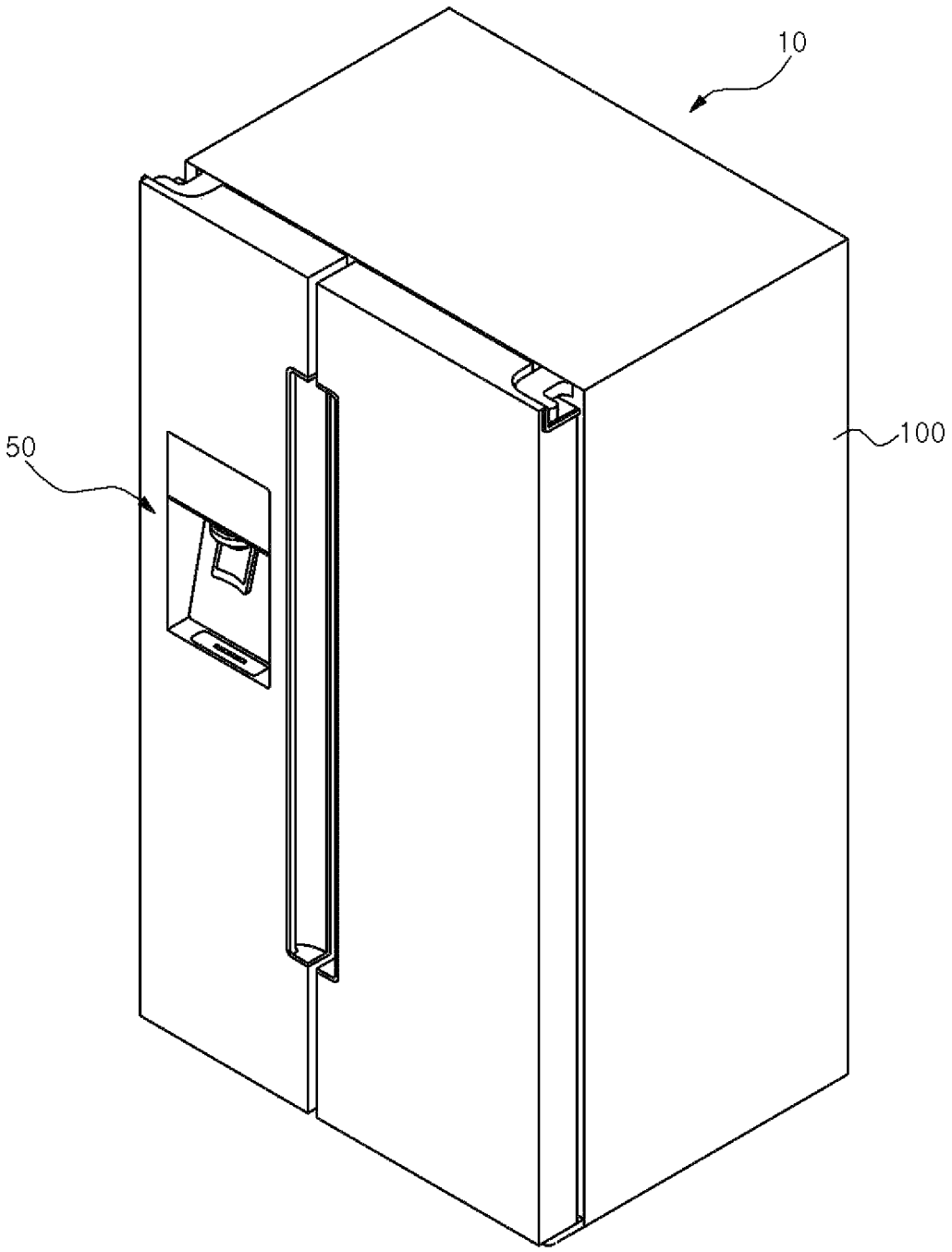
FIG. 1 is a perspective view of an exemplary refrigerator according to an embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is just exemplificative and not limitative. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include modification due to manufacturing.

Preferred embodiments of the present disclosure will now be described in detail with reference to the accompanying drawings.

Figure 2:
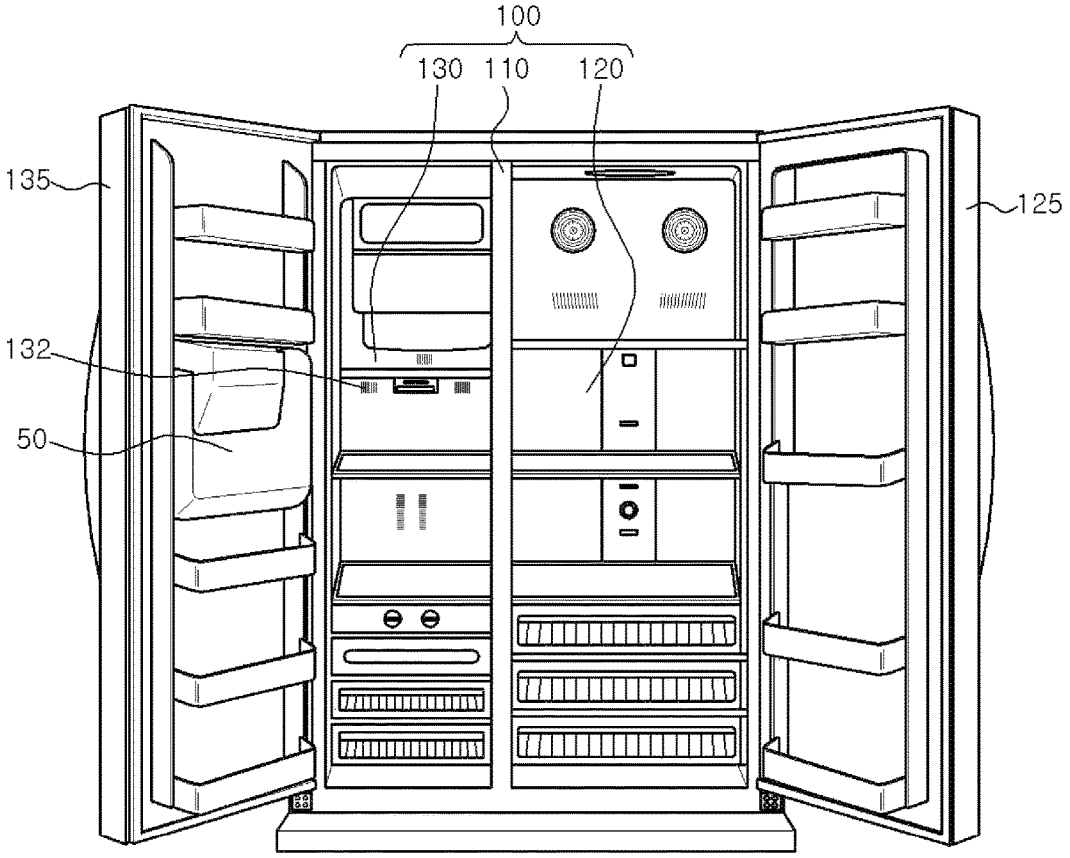
FIG. 2 is a front view showing an inside of the exemplary refrigerator shown in FIG. 1.
Figure 3:
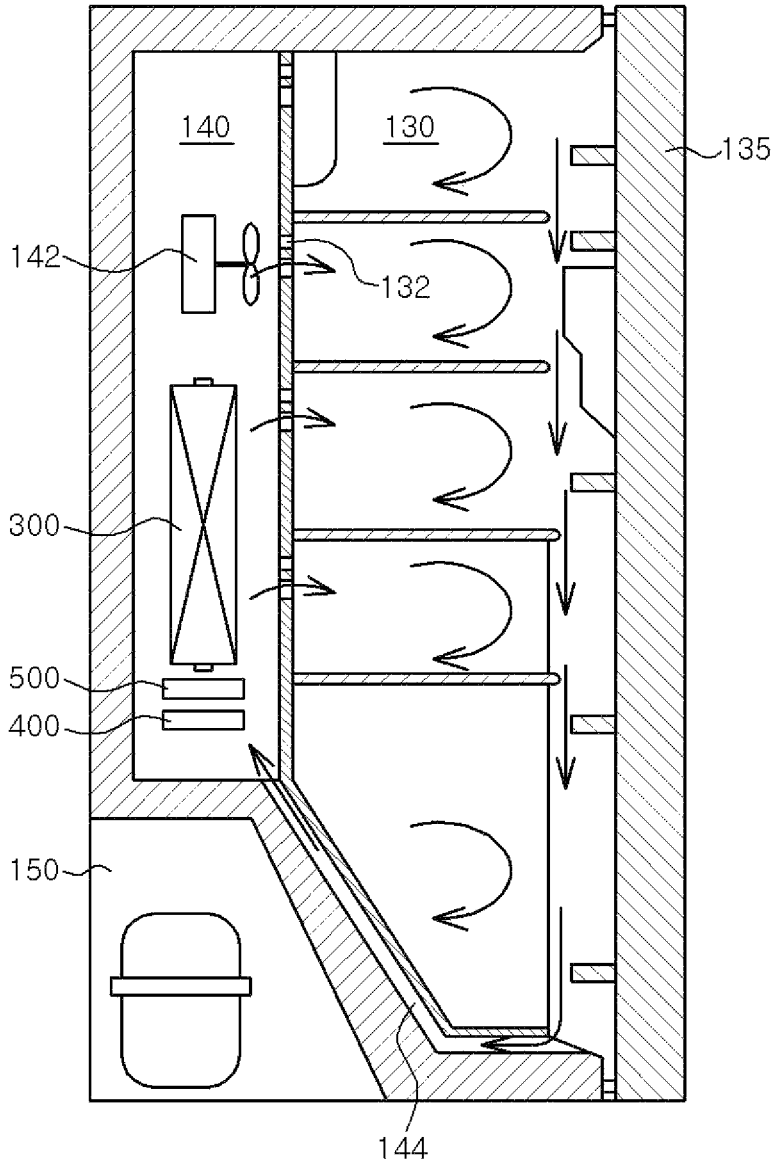
FIG. 3 is a cross sectional view of an exemplary freezer of the refrigerator shown in FIG. 1.

FIG. 1 is a perspective view of an exemplary refrigerator according to an embodiment of the present disclosure. FIG. 2 is a front view showing an inside of the exemplary refrigerator shown in FIG. 1. FIG. 3 is a cross sectional view of an exemplary freezer of the refrigerator shown in FIG. 1.

Referring to FIGS. 1 to 3, a refrigerator 10 according to an embodiment may include: a main body 100 having a storage space; a refrigerant line 200 in the main body 100 through which a refrigerant flows; an evaporator 300 disposed in the main body 100 and configured to generate cold air by evaporating the refrigerant flowing through the refrigerant line 200; a defrosting heater 400, installed below the evaporator 300 and configured to remove frost deposited on the evaporator 300; and a moisture absorbing unit 500 installed between the evaporator 300 and the defrosting heater 400 and configured to absorb moisture in cold air around the evaporator 300. Cold air in the vicinity of the evaporator 300 is generally referred to as "returned cold air" herein, which includes, but not limited to, cold air that has circulated through the refrigerator and returned back to the vicinity of the evaporator.

The main body 100 may have a storage space for storing items. Hereinafter, an example is described in which the main body 100 is divided by a barrier wall 110 into a right and a left side, corresponding to a refrigeration room 120 and a freezer 130 respectively. However, the present disclosure is not limited by the configuration of the storage space or the type of refrigerator.

Stored items can be refrigerated in the refrigeration room 120. An inner space of the refrigeration room 120 can be sealed or closed off by a refrigeration room door 125. The refrigeration room door 125 can rotate with its upper end and lower end hingedly coupled to the main body 100.

Stored items can be frozen in the freezer 130. The freezer 130 can be partitioned from the refrigeration room 120 by the barrier 110. An inner space of the freezer door 135 can be sealed or closed off by a freezer door 135. The freezer door 135 can rotate with its upper end and lower end hingedly coupled to the main body 100.

A water dispenser 50 can be installed at a front surface of the freezer door 135. The dispenser 50 may be recessed on the front surface of the freezer door 135. Accordingly, a user can obtain cold water and hot water through the dispenser 50 without opening the freezer door 135.

A cold air generation compartment 140 may be disposed at a rear side of the freezer 130 by a rear wall of the freezer 130. Components in the cold air generation compartment 140 can operate to produce and supply cold air to the freezer 130 through cold air discharge holes 132 present in the rear wall of the freezer 130.

The refrigerant line 200 can be disposed in the main body 100. More specifically the refrigerant line 200 may be bent in multiple turns and provides a flow path for the refrigerant.

The refrigerant is a working fluid circulating in refrigerant line 200 during a cooling cycle and thereby can cool the air outside the refrigerant line. A general cooling cycle includes processes of compression-condensation-expansion-evaporation. Cold air is generated by repeating the cooling cycle.

More specifically, a refrigerant in a low-temperature and low-pressure gaseous state is compressed into a refrigerant in a high-temperature and high-pressure gaseous state by a compressor (not shown). Then, the refrigerant in the high-temperature and high-pressure gaseous state is condensed into a refrigerant in a high-temperature and high-pressure liquid state by a condenser (not shown). Next, the refrigerant in the high-temperature and high-pressure liquid state is expanded into a refrigerant in a low-temperature and low-pressure liquid state by an expansion device (not shown). Thereafter, the refrigerant in the low-temperature and low-pressure liquid state is transferred to the evaporator 300. In the evaporator 300, the refrigerant in the low-temperature and low-pressure liquid state absorbs heat from air surrounding the evaporator 300 and thereby evaporates. Accordingly, air near the evaporator 300 loses heat and becomes cold air. The compressor, the condenser and the expander may be disposed in a machine room 150 disposed at a lower portion of the main body 100 for instance, and the evaporator 300 may be disposed in the cold air generation compartment 140.

In the present embodiment, both the refrigeration room 120 and the freezer 130 can be cooled by a single evaporator 300 disposed at a rear side of the freezer 130. However, in some other embodiments, a separate evaporator 300 can be disposed in each of the refrigeration room 120 and the freezer 130 respectively and independently cool the refrigeration room 120 or the freezer 130.

Cold air generated from the evaporator 300 may be discharged into the freezer 130 through the cold air discharge holes 132 located in the rear wall of the freezer 130 and a cooling fan 142 disposed above the evaporator 300. The cold air that has cooled the inside of the freezer 130 while circulating therein returns to the cold air generation compartment 140 through a cold air return duct 144 disposed at a lower portion of the main body 100.

Cold air that has returned through the cold air return duct 144 can exchange heat with the evaporator 300 and then is discharged to the freezer 130 through the cold air discharge holes 132 and the cooling fan 142. As cold air circulates through the freezer, the freezer 130 can be maintained at a predetermined temperature.

However, since the surface temperature of the evaporator 300 is usually lower than a temperature inside the refrigerator, condensate water may adhere to the surface of the evaporator 300 during heat exchange between the refrigerant and the air circulating in the refrigerator. The condensate water can freeze on the surface of the evaporator 300 and become frost. As frost accumulates on the evaporator 300, the amount of heat that can be absorbed from the air by the evaporator 300 decreases significantly. As a result, the heat exchange efficiency of the evaporator 300 deteriorates remarkably.

To remove frost from the evaporator 300, a defrosting operation is usually performed for melting the frost, which typically requires a shutdown of the cooling process. A defrosting heater 400 for performing the defrosting operation may be disposed below the evaporator 300.

The defrosting heater 400 is used to melt the frost on the evaporator 300. In one embodiment of the present disclosure, the defrosting heater 400 can emit heat and is heated to about 160° C. to 200° C. The heat can melt the frost on the evaporator 300. However, during such a defrosting operation, the overall temperature in the refrigerator is inevitably increased significantly by the heat emitted from the defrosting heater 400 and due to the shutdown of the cooling process. After the defrosting process, the refrigerator needs to be cooled down from a relatively high temperature. Therefore, the defrosting process undesirably leads to increased power consumption of the refrigerator 10.

Accordingly, it is advantageous to reduce the need for defrosting and shorten the time required for a defrosting operation. The refrigerator 10 according to an embodiment may include a moisture absorbing unit 500 capable of absorbing moisture contained in the cold air surrounding the evaporator 300. The moisture absorbing unit 500 is disposed between the evaporator 300 and the defrosting heater 400. The moisture absorbing unit 500 can absorb at least a part of the moisture contained in the returned cold air and also can dry the absorbed moisture from the returned cold air during a defrosting operation.

Figure 4:
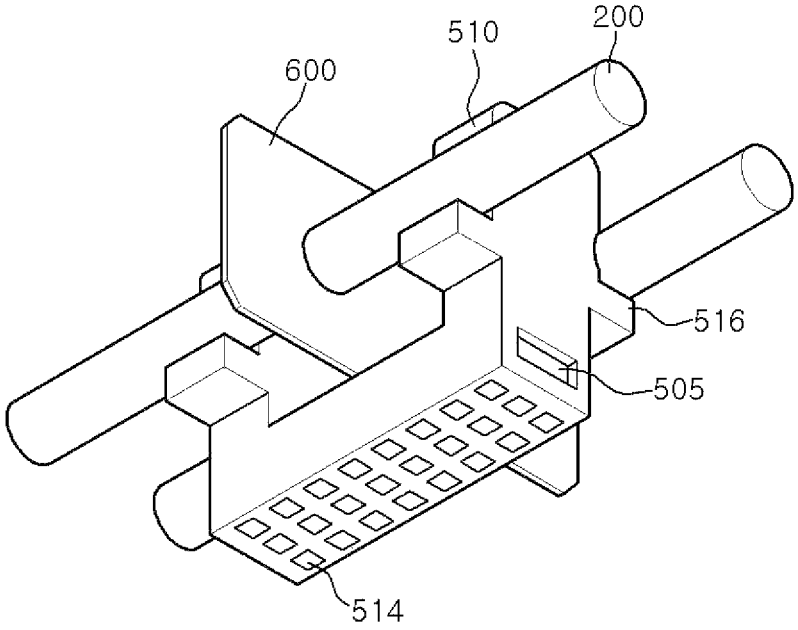
FIG. 4 is a perspective view of an exemplary moisture absorbing unit of the refrigerator shown in FIG. 1 according to an embodiment of the present disclosure.
Figure 5:
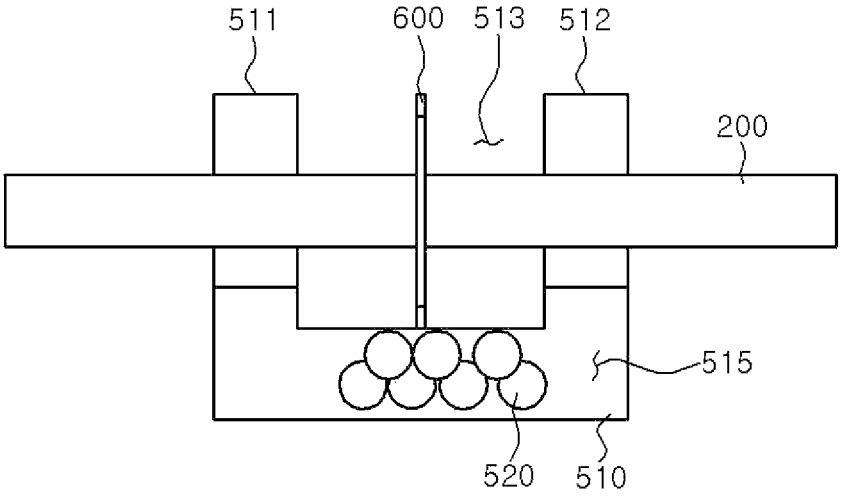
FIG. 5 is a side cross sectional view of the exemplary moisture absorbing unit shown in FIG. 4.
Figure 6:
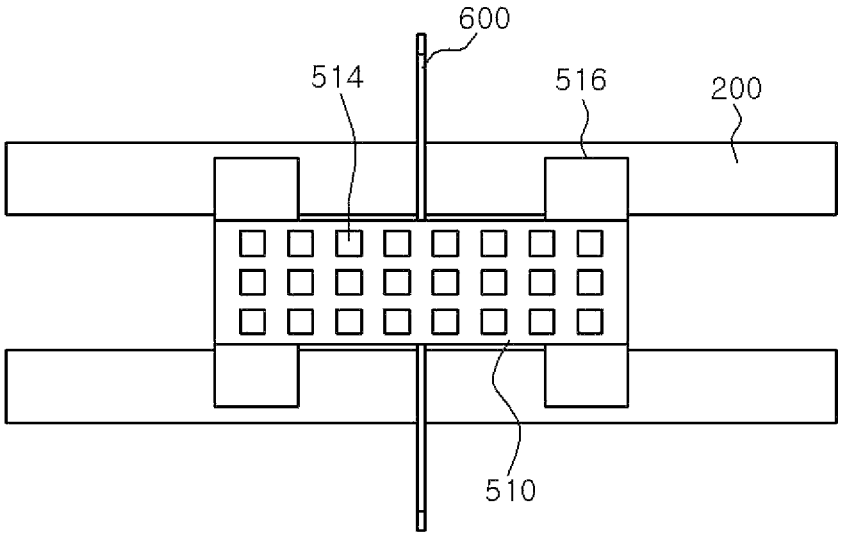
FIG. 6 is a bottom view of the exemplary moisture absorbing unit shown in FIG. 4.
Figure 7:
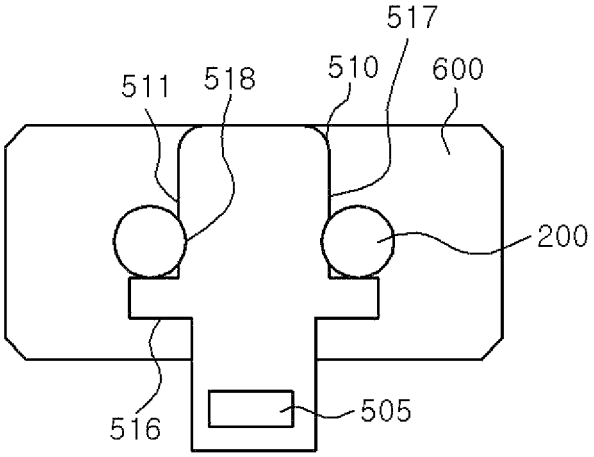
FIG. 7 is a front view of the exemplary moisture absorbing unit shown in FIG. 4.

Hereinafter, the exemplary moisture absorbing unit 500 is described with reference to FIGS. 4 to 7. FIG. 4 is a perspective view of the exemplary moisture absorbing unit according to an embodiment of the present disclosure. FIG. 5 is a side cross sectional view of the exemplary moisture absorbing unit shown in FIG. 4. FIG. 6 is a bottom view of the exemplary moisture absorbing unit shown in FIG. 4. FIG. 7 is a front view of the moisture absorbing unit shown in FIG. 4.

Referring to FIGS. 1 to 7, the moisture absorbing unit 500 may include: an accommodating case 510 coupled to a part in a lengthwise direction (right-left direction in FIG. 4) of the refrigerant line 200 and having small holes 514 through which the returned cold air can pass; and a moisture absorbing member 520 accommodated in an accommodating space 515 formed in the accommodating case 510.

To accommodate the moisture absorbing member 520 in the accommodating space 515 of the accommodating case 510, a door unit 505 may be coupled to the accommodating case 510.

With the moisture absorbing member 520 placed in the accommodating space 515 of the accommodating case 510, the door unit 505 may be covered by a cover (not shown) having fine holes through which the returned cold air can pass. In the present embodiment, the door unit 505 is formed at lower portions of one side portion 511 and the other side portion 512 of the accommodating case 510. However, this arrangement is merely exemplary. In some other embodiments, the door unit 505 may be formed at upper portions of one side portion 511 and the other side portion 512 of the accommodating case 510.

Accordingly, the returned cold air can efficiently pass through the accommodating case 510. Further, the moisture absorbing member 520 can be prevented from spilling out of the accommodating space 515, e.g., when the refrigerator is being moved for some reason. Moreover, a user can perform maintenance on the moisture absorbing member 520 or change the moisture absorbing member 520 with a new moisture absorbing member by removing the door unit cover from the door unit 505 and taking out the moisture absorbing member 520 through the open door unit 505.

As described above, the moisture absorbing unit 500 is disposed in a certain area of the cold air generation compartment 140 (e.g., between the evaporator 300 and the defrosting heater 400). In this manner, moisture contained in the returned cold air can be removed without disturbing the passage of the cold air returning to the cold air generation compartment 140. Fine holes 514 through which the returned cold air can pass may be formed in the bottom surface of the accommodating case 510.

More specifically when the returned cold air returns to the cold air generation compartment 140, the returned cold air passes through the fine holes 514 and reaches the moisture absorbing member 520. During the course of air flow, at least a part of the moisture contained in the returned cold air is absorbed by the moisture absorbing member 520 and dried. The dried returned cold air flows to the evaporator 300 to exchange heat.

The accommodating case 510 may have a square shape with the right side open. The first side portion 511 and the second side portion 512 of the accommodating case 510 are separated by a predetermined gap. A groove 513 is formed between the first side portion 511 and the second side portion 512. In FIG. 4, the accommodating case 510 is shown with a shape obtained by rotating the right side-opened square shape in a counterclockwise direction and is in a tight contact with the refrigerant line 200. Such a geometric configuration advantageously enables the moisture absorbing member 520 accommodated in the accommodating space 515 of the accommodating case 510 to be located close to the defrosting heater 400.

The accommodating case 510 may include protrusions 516 projecting from the outer surface of the accommodating case 510 which allow tight contact between the accommodating case 510 and the refrigerant line 200.

More specifically, the protrusions 516 may project from outer surfaces of the first side portion 511 and the second side portion 512 of the accommodating case 510. Due to the presence of the protrusions 516, a contact area between the accommodating case 510 and the refrigerant line 200 can be increased. Accordingly, the accommodating case 510 and the refrigerant line 200 can be securely coupled together.

Coupling grooves 518 having a radius of curvature corresponding to that of the refrigerant line 200 may be formed at side surfaces 517 above the projections 516 of the accommodating case 510. Due to the presence of the coupling grooves 518, the accommodating case 510 can be more firmly brought into contact with the refrigerant line 200.

The moisture absorbing member 520 can be accommodated in the accommodating case 510 and may absorb at least a part of the moisture in the cold air returning to the evaporator 300. The moisture absorbing member 520 may be composed of particles of silica having a net structure, e.g., silica gel which has excellent moisture absorption characteristics due to its large surface area.

Since the moisture contained in the returned cold air absorbed by the moisture absorbing member 520 can evaporate by the heat from the defrosting heater 400 during defrosting operations, one supply of moisture absorbing member 520 can be used repeatedly and continuously to absorb moisture in the returned cold air.

Generally, once being heated to about 100° C., the drying efficiency of silica gel may decrease considerably. Once being heated to 250° C. or above, silica gel may be thermally decomposed. As described above, the defrosting heater 400 according to an embodiment generates heat within a temperature range of about 160° C. to 200° C. Therefore, when the moisture absorbing member 520 is heated by the defrosting heater 400, the moisture absorbing member 520 will not be damaged and its moisture absorbing performance and the drying performance can be preserved. Accordingly, the moisture absorbing member 520 can advantageously be used for a long term, e.g., semi-permanently.

Returned cold air with its moisture being removed by the moisture absorbing member 520 is supplied to the evaporator 300 and becomes dried cold air after heat exchange with the evaporator 300. Dried cold air is then supplied to cool the freezer 130.

The refrigerator 10 according to an embodiment of the present disclosure may further include a cooling pin 600. The cooling pin 600 is a plate member used for improving heat exchange efficiency between air in the cold air generation compartment 140 and the refrigerant passing through the evaporator 300. The cooling pin 600 provides an increased surface area of the evaporator 300. The refrigerant line 200 penetrates through the cooling pin 600. The cooling pin 600 may be made of, e.g., aluminum having high thermal conductivity or the like. However, this implementation is merely exemplary and it will be appreciated that the material of the cooling pin 600 is not limited thereto.

Hereinafter, an exemplary operational process of the refrigerator 10 configured as described above is described.

During operation, the inside of the main body 100 of the refrigerator 10 is cooled by continuously supplied cold air. Cold air is continuously generated through the heat exchange process by recycling the refrigerant through the processes of compression, condensation, expansion and evaporation.

Cold air generated by such a process is distributed into the main body 100 through the cold air discharge holes 132 in the rear surface of the freezer 130 and the cooling fan 142 disposed above the evaporator 300.

Cold air circulates in the main body 100 and thereby maintains the main body 100 at a lower temperature. Cold air can then return to the cold air generation compartment 140 through the cold air return duct 144. At this time, the cold air returning to the cold air generation compartment 140 may contain high moisture concentration. Moisture contained in the cold air flow may come originate from moisture in the food stored in the freezer 130, moisture flowing into the freezer 130 from the outside, or the like.

According to the present disclosure, the refrigerator 10 includes the moisture absorbing unit 500 disposed between the evaporator 300 and the defrosting heater 400. Moisture contained in the cold air returning to the evaporator 300 can be advantageously absorbed by the moisture absorbing member 520 of the moisture absorbing unit 500.

Next, returned cold air of with moisture reduced or removed reaches the evaporator 300 and, through heat exchange with the evaporator 300, becomes cold air with low moisture content. The cold air with low moisture content is supplied into the refrigeration room 120 or the freezer 130 and used for maintaining the temperature in the refrigeration room 120 or the freezer 130 at a low level, e.g., at a user-determined temperature.

As described above, the refrigerator 10 according to the embodiment includes the moisture absorbing unit 500, so that moisture contained in the cold air returning to the evaporator 300 is prevented from being deposited as frost on the evaporator. Accordingly, heat exchange efficiency of the evaporator 300 can be advantageously improved.

Further, as the amount of frost deposited on the evaporator 300 is reduced due to the moisture absorbing unit 500, the need for a defrosting operation of the refrigerator 10 can be significantly reduced. Hence, defrost operations for such a refrigerator are less frequent compared with a refrigerator in the conventional art. Accordingly, overall power consumption of the refrigerator 10 can be decreased. Even when a defrosting operation is performed, the operation time of the defrosting heater 400 can be shortened and, thus, the power consumption of the refrigerator 10 is further decreased.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator comprising:
- a main body comprising a storage space;
- an evaporator disposed in the main body and configured to evaporate a refrigerant;
- a moisture absorbing unit disposed proximate to the evaporator and configured to absorb moisture from air surrounding the evaporator;
- a refrigerant line disposed in the main body and configured to provide a flow path for the refrigerant; and
- a defrosting heater configured to generate heat to remove frost adherent to the evaporator,
- wherein the moisture absorbing unit comprises:
- an accommodating case coupled to the refrigerant line and comprising holes for air to pass through and flow to the evaporator; and
- a moisture absorbing member accommodated in the accommodating case.

2. The refrigerator of claim 1, wherein the moisture absorbing unit is disposed between the evaporator and the defrosting heater.

3. The refrigerator of claim 1, wherein the defrosting heater is disposed below the evaporator.

4. The refrigerator of claim 1, wherein the moisture absorbing member is configured to absorb moisture from air, and wherein the defrosting heater is further configured to evaporate moisture absorbed by the moisture absorbing member during a defrost operation.

5. The refrigerator of claim 1, wherein the accommodating case comprises protrusions projecting from an outer surface of the accommodating case, and wherein further the protrusions enhances contact between the accommodating case and the refrigerant line.

6. The refrigerator of claim 5 further comprising coupling grooves having a shape that conforms to a radius of curvature of the refrigerant line, said coupling grooves being disposed at side surfaces of the accommodating case and above the protrusions of the accommodating case.

7. The refrigerator of claim 1, wherein the moisture absorbing member comprises silica gel.

8. The refrigerator of claim 1 further comprising a cooling pin coupled to the moisture absorbing unit and operable to increase a surface area of the evaporator, wherein the refrigeration line is routed through the cooling pin.

9. A refrigerator comprising:
- a refrigerant line providing a flow path for a refrigerant;
- an evaporator configured to evaporate the refrigerant for supplying cold air for the refrigerator;
- a defrosting heater configured to remove frost adherent to the evaporator;

a cooling pin configured to allow the refrigeration line to be routed therethrough and further operable to increase a surface area of the evaporator; and a moisture absorbing unit disposed proximate to the evaporator and configured to absorb moisture from air surrounding the evaporator, wherein the moisture absorbing unit comprises:

an accommodating case coupled to the refrigerant line and comprising holes for air to pass therethrough and flow to the evaporator; and a moisture absorbing member accommodated in the accommodating case.

10. The refrigerator of claim 9, wherein the defrosting heater is disposed under the evaporator, and wherein further the moisture absorbing unit is disposed between the evaporator and the defrosting heater.

11. The refrigerator of claim 9, wherein the moisture absorbing member is configured to absorb moisture from air, and wherein the defrosting heater is configured to evaporate moisture absorbed by the moisture absorbing member during a defrost operation.

12. The refrigerator of claim 11, wherein the accommodating case comprises protrusions projecting from an outer surface of the accommodating case, and wherein the protrusions are configured to enhance contact between the accommodating case and the refrigerant line.

13. The refrigerator of claim 12 further comprising coupling grooves having a shape that conforms to a radius of curvature of the refrigerant line, wherein the coupling grooves are disposed at side surfaces of the accommodating case and positioned above the protrusions of the accommodating case.

14. The refrigerator of claim 9, wherein the moisture absorbing member comprises silica gel.

* * * * *